US006846243B2

(12) United States Patent
Francisco

(10) Patent No.: US 6,846,243 B2
(45) Date of Patent: Jan. 25, 2005

(54) PUTTING POOL GAME

(76) Inventor: Dennis W. Francisco, 909 Lynn, Mt. Vernon, MO (US) 65712

( * ) Notice: Subject to any disclaimer, the term of this patent is extended or adjusted under 35 U.S.C. 154(b) by 0 days.

(21) Appl. No.: 10/409,456

(22) Filed: Apr. 9, 2003

(65) Prior Publication Data

US 2004/0204256 A1 Oct. 14, 2004

(51) Int. Cl.[7] ..... A63D 15/00; A63D 13/00

(52) U.S. Cl. ..... 473/3; 473/19; 273/123 R; 273/118 R

(58) Field of Search ..... 473/1, 3, 4, 6, 473/9, 10, 13–15, 18, 20, 28

(56) References Cited

U.S. PATENT DOCUMENTS

| | | | | | |
|---|---|---|---|---|---|
| 223,208 | A | * | 12/1879 | Disston | 473/19 |
| 278,341 | A | * | 5/1883 | Kelly | 473/3 |
| 1,311,671 | A | * | 7/1919 | Woods | 473/13 |
| 2,827,299 | A | * | 3/1958 | Dean | 473/158 |
| 3,578,321 | A | | 5/1971 | Skully et al. | |
| 3,802,707 | A | | 4/1974 | Frost | |
| 3,917,264 | A | | 11/1975 | Davidson et al. | |
| 3,976,294 | A | | 8/1976 | Maldonado | |
| 4,026,556 | A | * | 5/1977 | Taylor et al. | 273/123 R |
| 4,294,449 | A | | 10/1981 | Shaw | |
| D264,357 | S | * | 5/1982 | Martin | D21/335 |
| 4,544,156 | A | * | 10/1985 | Rasmussen et al. | 473/13 |
| 4,854,589 | A | * | 8/1989 | Davis | 273/123 R |
| 4,957,288 | A | | 9/1990 | Kantner et al. | |
| 5,029,863 | A | * | 7/1991 | Krawczyk et al. | 273/125 R |
| 5,039,099 | A | | 8/1991 | Bravo | |
| 5,116,048 | A | | 5/1992 | Bilocerkowycz et al. | |
| D340,951 | S | * | 11/1993 | Howrilka et al. | D21/312 |
| 5,735,749 | A | * | 4/1998 | Charbel et al. | 473/3 |
| 5,785,615 | A | * | 7/1998 | Kosmalski | 473/471 |
| 6,168,533 | B1 | * | 1/2001 | Camara | |
| 6,319,141 | B1 | * | 11/2001 | Cartee | |
| 6,371,861 | B1 | * | 4/2002 | Ellingsberg | |
| 6,729,964 | B2 | * | 5/2004 | Reeves, Jr. | 473/2 |

FOREIGN PATENT DOCUMENTS

| | | | | | |
|---|---|---|---|---|---|
| DE | 0432589 | A1 | * | 6/1991 | A63D/15/02 |
| FR | 2278362 | A | * | 3/1976 | A63B/67/06 |

* cited by examiner

*Primary Examiner*—Mitra Aryanpour
(74) *Attorney, Agent, or Firm*—Richard C. Litman

(57) ABSTRACT

The game is a putting pool game played by a plurality of players. The putting pool game includes a game frame, a plurality of ball receiving holes, at least two sets of balls where each set of balls is a different color, at least one striker ball and a plurality of ball striking clubs. Each of the players is assigned a particular set of balls. The game is started by dumping the sets of balls out of a storage bucket into an open area inside of the game frame. One player places the striker ball at one end of the game frame for a first shot and each player takes alternating shots by hitting the striker ball into his particular set of balls in an attempt to project his set of balls through the ball receiving holes.

11 Claims, 7 Drawing Sheets

PUTTING POOL GAME

BACKGROUND OF THE INVENTION

1. Field of the Invention

The present invention relates to golf games and more particularly to a golf putting pool game that may be used on any interior or exterior surface.

2. Description of the Related Art

Golf putting games and pool table games are both well known in the art. There are many varying types of pool table games with many varying rules. There are also many types of golf putting games that utilizes miniature golf courses for practicing putting. The following documents provide examples of existing golf and table pool games.

U.S. Pat. No. 3,578,321 issued to Skully et al. discloses a putter-pool game device. The game is a portable package that has a carpeted playing surface. The package further includes edges defining a pool table configuration with bumpers and pockets. The game unfolds to lay flat on a floor. Golf balls and putters are used to play a game similar to pool where a cue ball is putted into other golf balls in an attempt to knock the golf balls into the pockets of the portable package.

U.S. Pat. No. 3,802,707 issued to Frost discloses a recreational device. The recreational device is a game that provides a playing surface surrounded by a railing. A plurality of gates are disposed along the railing. A plurality of pegs are mounted to and extend upwardly from the playing surface. Playing balls are scattered on the playing surface and a mallet is used to knock the balls through the gates. The balls must strike one of the pegs before going through the gates.

U.S. Pat. No. 3,917,264 issued to Davidson et al. discloses a billiard game apparatus. The billiard game apparatus includes a source of black light radiation directed onto the playing surface. The billiards balls have a coating of luminescent material that is responsive to black light so that the billiards balls emit visible light.

U.S. Pat. No. 3,976,294 issued to Maldonado discloses an improved game table. The game table is used for playing an improved game of pool. The game table includes only four pockets, located in the center of each side wall of the table surface. The table does not include corner pockets. The corners of the table include slightly arcuate cushion segments to prevent the balls from being entrapped in the corners.

U.S. Pat. No. 4,294,449 issued to Shaw discloses an amusement device. The device includes a rhomboid shaped table with a plurality of ball receiving holes. A cue is provided for striking multicolored playing pieces. Each player is designated particular pieces of a certain color. Each player takes turns striking the cue with a cue stick. The object is to strike the cue so that the cue makes contact with an opposing players pieces and moves them into one of the receptacles located on either end of the playing surface.

U.S. Pat. No. 4,957,288 to Kantner et al. discloses a putter pool billiard game. A golf putting game is disclosed that comprises a rectangular framework for use on a flat surface with pockets disposed within the framework for capturing a golf ball during the play of the game. Each of the pockets has an inwardly inclined floor to retain the golf ball in the pocket. The game allows the user to practice putting a golf ball into the pockets in the frame.

U.S. Pat. No. 5,039,099 issued to Bravo discloses a chip game apparatus. The apparatus includes a planar surface with pockets formed in each corner of the surface. Each player is given a certain number of discs that must be knocked into the corner pockets. Each player has a cue stick for striking a cue disc into the player's own discs.

U.S. Pat. No. 5,116,048 to Bilocerkowycz et al. discloses a golf game and method for playing the game. The golf game includes a playing surface that is laid on the ground. The playing surface has four golf ball cups. The object of the game is to put the golf ball into the cup. The playing surface also includes a number of bumper rails for deflecting the golf ball. The golf game also includes removable obstructions that may be placed in different places on the golf course.

U.S. Pat. No. 6,168,533 issued to Camara discloses a portable golf game that includes a plurality of rails and a plurality of ball pockets that are arranged between adjacent rails. The pockets and the rails define a boundary for a playing surface. The rails include fasteners for securing the boundary to the playing surface.

U.S. Pat. No. 6,319,141 issued to Cartee discloses a variable point pool table. The present pool table includes sixteen pockets as opposed to the normal six pockets. Some of the pockets vary in size. Each of the balls is given a specific point value. Each of the holes is given a specific point value. The player's score is determined by multiplying the pocket value by the ball value when a ball is knocked into a pocket.

U.S. Pat. No. 6,371,861 issued to Ellingsberg discloses a bumper pocket billiard table. The table has a circular playing surface bounded by a circular rail with a plurality of pockets positioned in the perimeter portion of the playing surface. At least one bumper post is positioned on the playing surface.

None of the golf or pool games provide a portable game that may be used on any surface and is easily stored when not in use that utilizes the skills and features of both golf and table pool. Therefore what is need is a game that combines the skills and features of golf and pool. What is further needed is a portable putting pool game that may be easily assembled, disassembled and stored. What is still further needed is a portable putting pool game that may be used on any interior or exterior surface. What is still further needed is a putting pool game that is offered in varying sizes to accommodate varying sized playing areas.

SUMMARY OF THE INVENTION

The putting pool game according to the present invention comprises a plurality of side boards, a plurality of end boards, a plurality of ball receiving holes, a top rail, a bottom rail, a plurality of ball strikers, a plurality of projections balls and a striker ball. Adjacent side boards are pivotally secured to one another to from side walls. The side boards are attached at their adjacent ends by a hinge, which allows the side wall to be folded in half for storing the game. The end boards are releasably attached to the side walls by angled fastening plates to form a generally rectangular game frame. The putting pool game further comprises an open playing area defined within the game frame.

The plurality of ball receiving holes are disposed along a bottom portion of the game frame. The ball receiving holes extend through the entire thickness of the game frame to allow the projection balls to pass out of the open playing area. A ball receiving hole is positioned in each of the corners of the game frame. Additional ball receiving holes are positioned along the side walls of the game frame. The top rail is disposed along the top surface of the game frame. The bottom rail is disposed along the bottom portion of the game frame.

The plurality of ball strikers are in the form of golf putting clubs. The ball strikers are used to apply a force to the striking ball. The striking ball then makes contact with the projection balls in an attempt to propel the projection balls out of the open playing area through the ball receiving holes. The projection balls comprise two sets of balls where each set is assigned to an individual player. Each individual set of projections balls is a different color to differentiate each player's balls.

The putting pool game optionally comprises an illumination source. The illumination source is preferably a black light. If the optional black light illumination source is used portions of the game frame, the ball receiving holes, the plurality of projection balls and the striker balls are coated with a material that reacts to black light.

The game frame is easily disassembled and folded away for storage. The end boards are slidably removed from the fastening plates on the side walls. The sidewalls are then folded along the seam created by the adjacent sideboards. The hinge that connects the side boards allows the side wall to be folded in this manner. A container is provided for storing the plurality of projection balls and the striker ball.

To begin play of the putting pool game each player is assigned a set of projection balls. One of the players then dumps the projection balls out of the storage container onto the open playing area inside of the game frame. A second player places the striker ball at one end of the game box for a first shot. Each player takes alternating shots by applying a force on the striker ball with a ball striking club to force the striker ball into contact with one of the projection balls in that player's set of balls. A player will continue to take shots as long as he continues to project the projection balls through the ball receiving holes in sequence. The game is continued until one of the players successfully projects his entire set of balls out of the open playing area through the ball receiving holes.

The putting pool game also provides two alternate ways to play the game. The putting pool game optionally comprises a center board that can be positioned between the side walls and parallel to the end boards. The center board includes at least one ball receiving hole along its bottom portion. The center board allows the players to play a different game where the goal is to transfer your entire set of balls from side of the center wall to the other. The putting pool game also provides a practice game for situations where there is not enough room to set up the entire game frame. The practice game provides a smaller board with a single ball receiving hole that may be set up to practice putting.

Accordingly, it is a principal object of the invention to provide a game that combines the skills and features of golf and pool.

It is another object of the invention to provide a portable putting pool game that may be easily assembled, disassembled and stored.

It is a further object of the invention to provide a portable putting pool game that may be used on an interior or exterior surface.

Still another object of the invention is to provide a putting pool game that is offered in varying sizes to accommodate varying sized playing areas.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
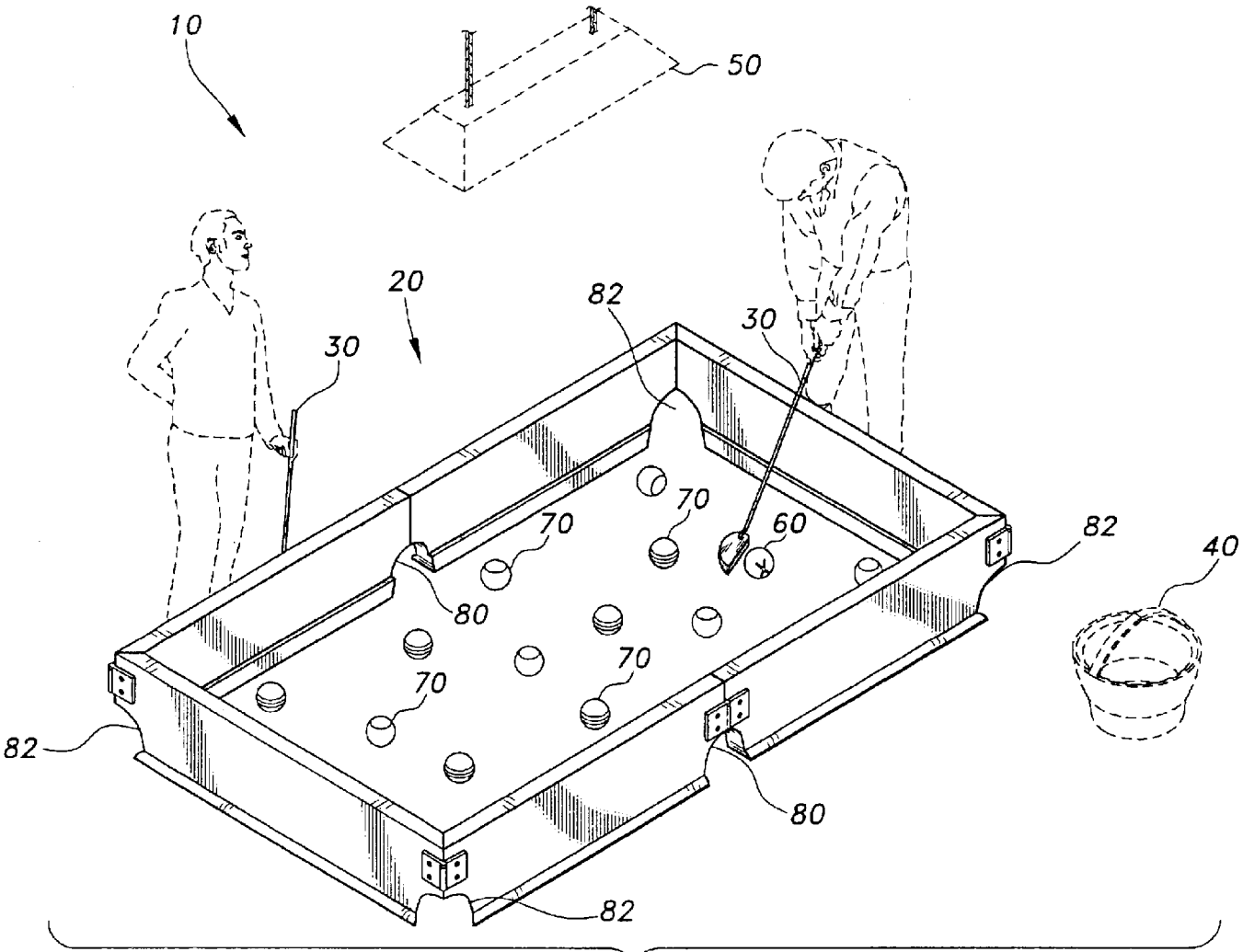
FIG. 1 is an environmental, perspective view of a putting pool game according to the present invention.

The present invention is a putting pool game that incorporates the skills and features of golf and ordinary table pool. FIG. 1 is an environmental perspective view of two players using the putting pool game 10. The putting pool game 10 comprises a game frame 20, a plurality of ball striking clubs 30, a ball storage container 40, at least one striker ball 60 and a plurality of projection balls 70.

The putting pool game 10 further comprises a plurality of ball receiving holes disposed along a bottom portion of the game frame 20. The ball receiving holes are adapted to allow a ball to pass through the game frame 20. In the preferred embodiment depicted in FIG. 1 the putting pool game 20 includes four corner ball receiving holes 82 positioned in each corner of the game frame 20. The putting pool game 20 also includes two side ball receiving holes 80 that are disposed along the walls of the game frame 20. The location of the ball receiving holes depicted in FIG. 1 is merely illustrative of a preferred embodiment and the ball receiving holes may vary in number and location.

Figure 2:
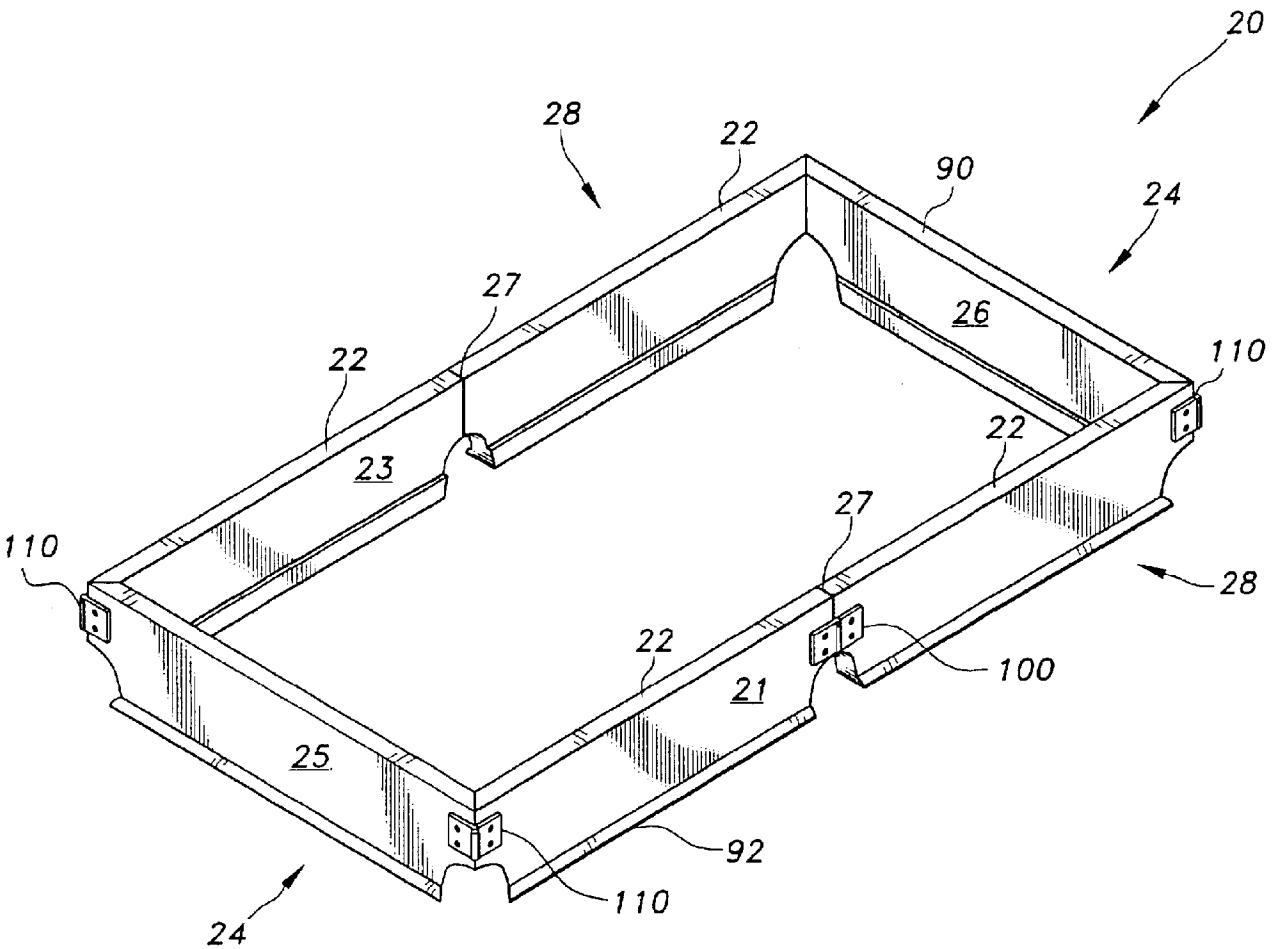
FIG. 2 is a top perspective view of the frame of the putting pool game.

FIG. 2 depicts a top perspective view of the game frame 20. The game frame 20 comprises a plurality of end boards 24 and a plurality of side walls 28. In the preferred embodiment depicted in FIG. 2 the game frame 20 comprises two end boards 24 and two sidewalls 28 to define a generally rectangular playing area inside of the game frame 20. The side walls 28 are comprised of a pair of adjacent side boards 22. The side boards 22 are pivotally secured to one another by a hinge 100 along a center side wall seam 27. The hinge 100 is disposed on the exterior surface 21 of the side boards 22. Additional side boards 22 may be added to the side wall 28 to increase the size of the game frame 20. The additional side boards 22 would be attached to the existing side boards 22 with a hinge 100 in the same manner as depicted in FIG. 2. The game frame 20 can be placed on any surface. There is no bottom surface to the game frame 20 and the open playing area defined by the game frame 20 is filled by the surface that the game frame 20 is placed on.

The end boards 24 are releasably secured to each end of the side walls 28. The end boards 24 are disposed perpendicularly in relation to the side walls 28. The end boards 24 are fastened to the sidewalls 24 using angled fastener plates 110. The angled fastener plates are disposed on the exterior surface 21 of the side boards 22 and the exterior surface 25 of the end boards 24.

The game frame 20 further comprises a top guard rail 90 and a bottom guard rail 92. The top guard rail 90 is disposed along the top surface of the side boards 22 and the end boards 24. The bottom rail 92 is disposed along the bottom surface of the side boards 22 and the end boards 24. The top rail 90 and the bottom rail 92 are added to the game frame 20 to improve its aesthetic appeal. The bottom rail 90 also functions to protect the game frame 90 from wear and tear damage during game play.

The plurality of ball receiving holes allow the plurality of projections balls 70 (depicted in FIG. 1) to pass out of the playing area defined by the game frame 20. The plurality of side ball receiving holes 80 extend from the interior surface 23 of the side boards 22 to the exterior surface 21 of the side boards 22. The plurality of corner ball receiving holes 82 also extend through the side walls as well as extending from the interior surface 26 of the end boards 24 to the exterior surface 25 of the end boards 24. The ball receiving holes allow the projections balls 70 to exit the playing surface by passing completely through the game frame 20.

Figure 3:
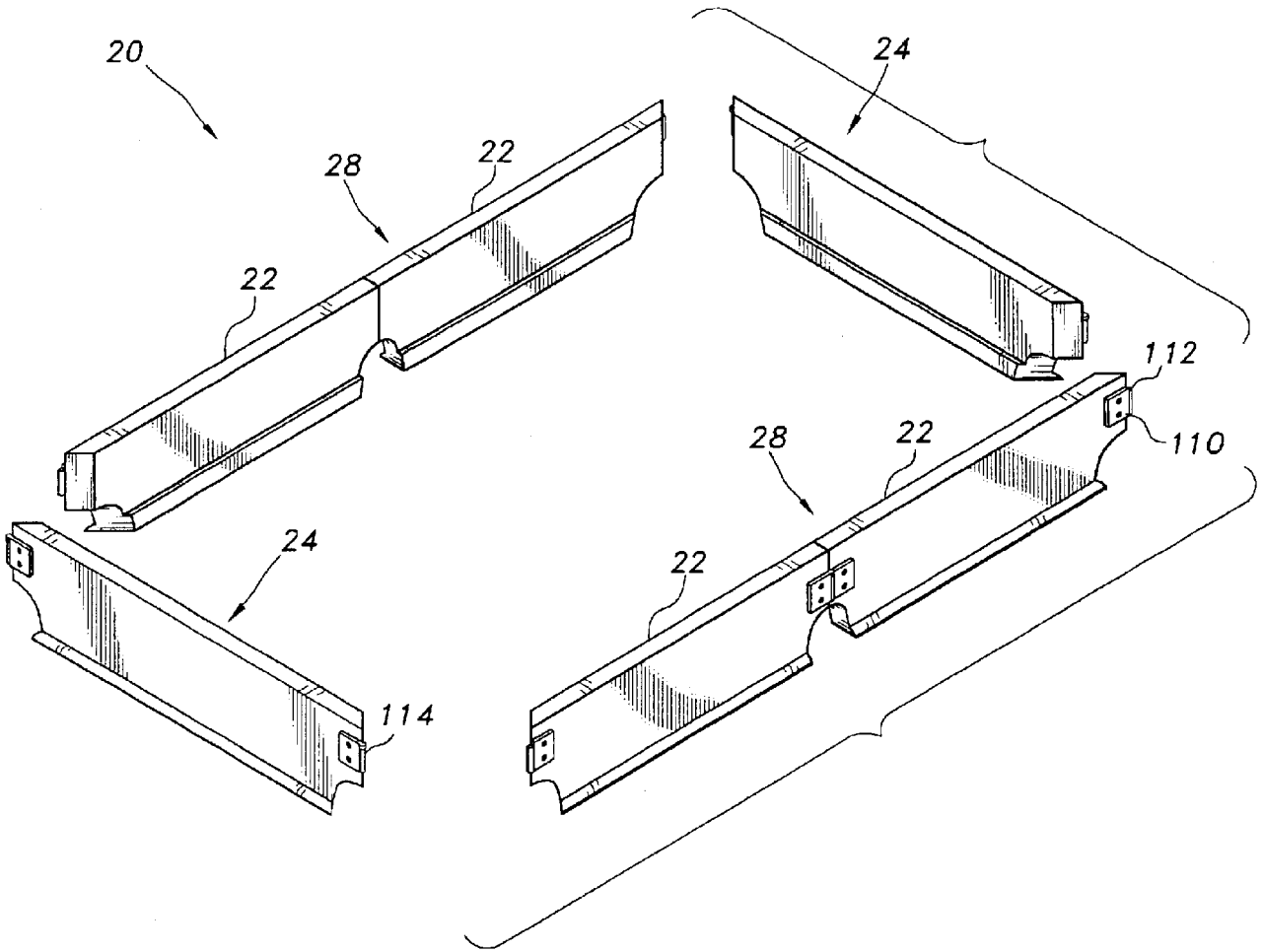
FIG. 3 is an exploded perspective view of the frame of the putting pool game depicted in FIG. 2.

FIG. 3 depicts an exploded perspective view of the game frame 20. The game frame 20 is easily disassembled for compact storage while the putting pool game 10 is not in use. The end boards 24 are slidably released from the side walls 28. The fastener plates 110 are easily separated into two pieces to allow the end boards 24 to be removed. The portion of the fastener plate 110 disposed on the end boards 24 comprises a fastener rod 114. The fastener rod 114 slidably engages a fastener slot 112 on the portion of the fastener plate 110 disposed on the side board 22.

Figure 4:
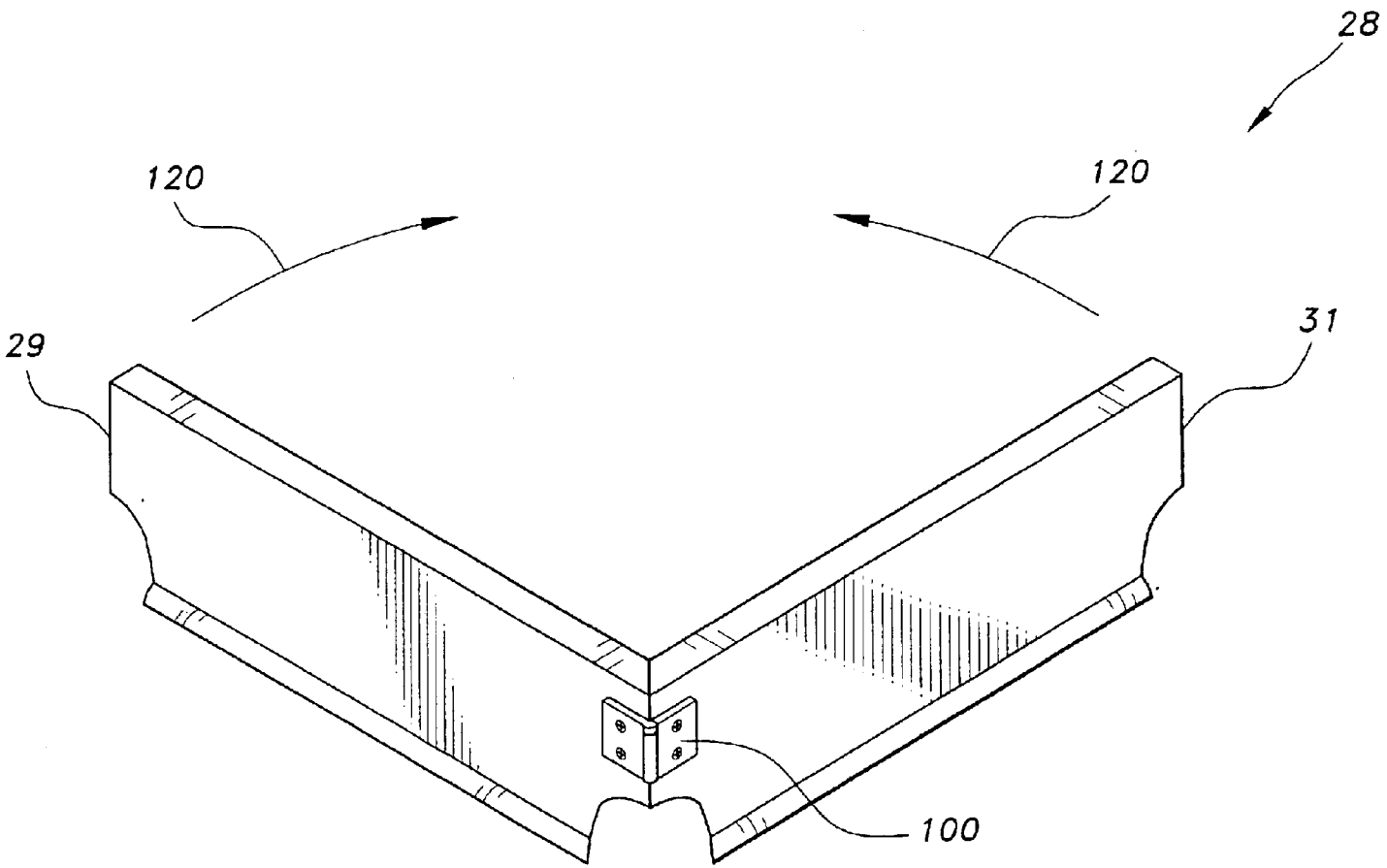
FIG. 4 is a front perspective view of a side panel of the frame depicted in FIG. 2.

FIG. 4. is a enlarged perspective view of a sidewall 28. Once the end boards 24 are removed from the sidewalls 28, the sidewall 28 is folded to make them more compact for storage. The sidewall 28 is folded by forcing the unhinged ends 29, 31 of the side boards 22 together. The path of the folding is indicated by arrows 120 in FIG. 4. The side boards are folded about the hinge 100. The side boards 22 are folded until the unhinged ends 29, 31 come into contact. Once folded, the side walls 28 and the end boards 24 are easily stacked for storing.

Figure 5:
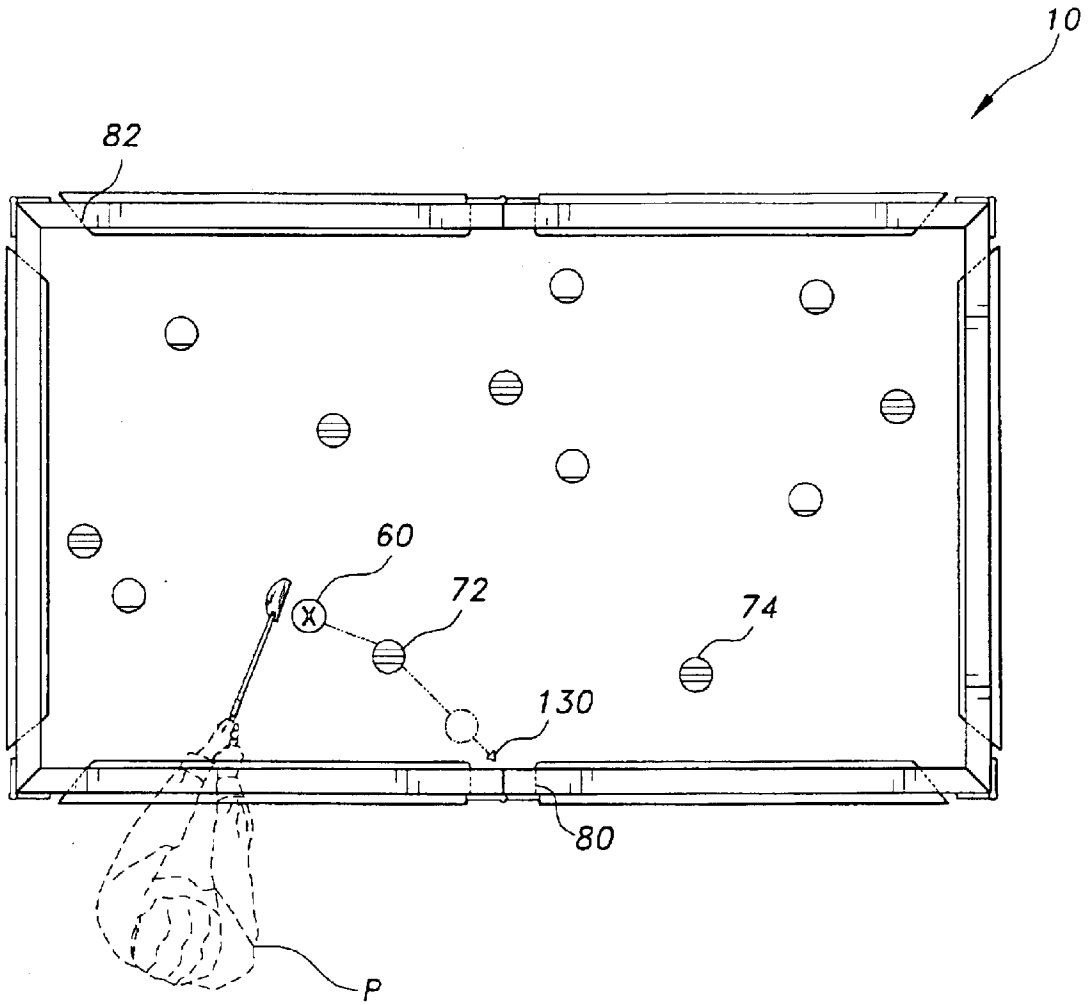
FIG. 5 is a top view of an individual playing the putting pool game.

FIG. 5 is a top view of a player P playing the putting pool game 10. The player P is holding one of the plurality of ball striking clubs 30. The ball striking club is preferably in the shape of a golf putter. The ball striking club 30 is used to apply a force to the striking ball 60. The striking ball 60 then makes contact with the projection balls 70 in an attempt to propel the projection balls 70 out of the open playing area through the ball receiving holes 80. The projection balls comprise a first set of balls 72 and a second set of balls 74, where each set is assigned to an individual player. Each individual set of projections balls is a different color to differentiate each players balls. In FIG. 5 the first set of projection balls 72 is stripped and the second set of projection balls is solid 74. The arrow 130 depicts the desired path of the striker ball 60 and the projection ball 72.

To begin playing the putting pool game each player is assigned a set of projection balls 70. One of the players P then dumps the projection balls 70 out of the storage container 40 onto the open playing area inside of the game frame 20. A second player P places the striker ball 60 at one end of the game frame 20 for a first shot. Each player takes alternating shots by applying a force on the striker ball 60 with a ball striking club 30 to force the striker ball 60 into contact with one of the projection balls 70 in that player's set of balls. A player P will continue to take shots as long as he continues to project the projection balls 70 through the ball receiving holes 80,82 in sequence. The game is continued until one of the players P successfully projects his entire set of balls 72,74 out of the open playing area through the ball receiving holes 80,82.

During play of the game, the player P may not stand inside of the game frame 20. The striker ball 60 is played from where it lies after the last shot, the player P may not move the ball before his shot. If the striker ball 60 is knocked through one of the ball receiving holes 80,82 the player P that knocked it out will knock the striker ball 60 back through the ball receiving hole 80,82 it came through to resume the game. A projection ball 70 will not be considered out of the game until it completely clears through the game frame 20. If a player P knocks an opposing player's projection ball 70 out of the game frame 20 the player loses his turn and it results in a score for the opposing player.

Referring to FIG. 1, the putting pool game 10 optionally comprises an illumination source 50. The illumination source 50 is preferably a black light. In the preferred embodiment the illumination source 50 hangs above the game frame 20. If the optional black light illumination source 50 is used portions of the game frame 20, the ball receiving holes 80,82, the plurality of projection bails 70 and the striker ball 60 are coated with a material that reacts to black light.

Figure 6:
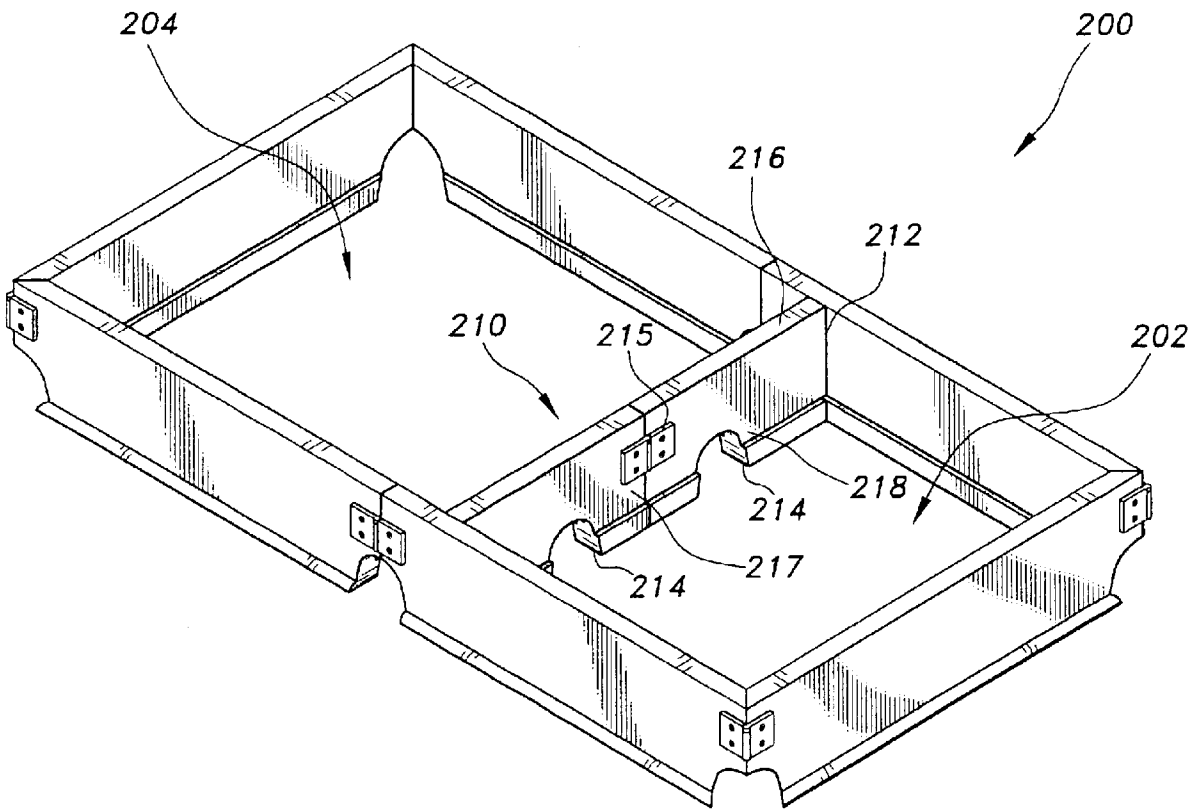
FIG. 6 is a perspective view of a second embodiment of the putting pool game.

FIG. 6 is a perspective view of a second embodiment of the game frame 200. The second embodiment of the game frame 200 comprises all of the elements of the first preferred embodiment discussed above but additionally comprises a center board 210 that is positioned between the side walls and parallel to the end boards of the game frame 200. The center board 210 comprises at least one ball receiving hole 214 along its bottom portion. The center board 210 also comprises a first portion 217 and a second portion 218 that are pivotally connected by a hinge 215 in the same manner that the side boards 22 are connected. The center board 210 allows the players to play a different game where the goal is to project your entire set of balls from a first side 202 of the center board 210 to a second side 204 of the center board 210.

Figure 7:
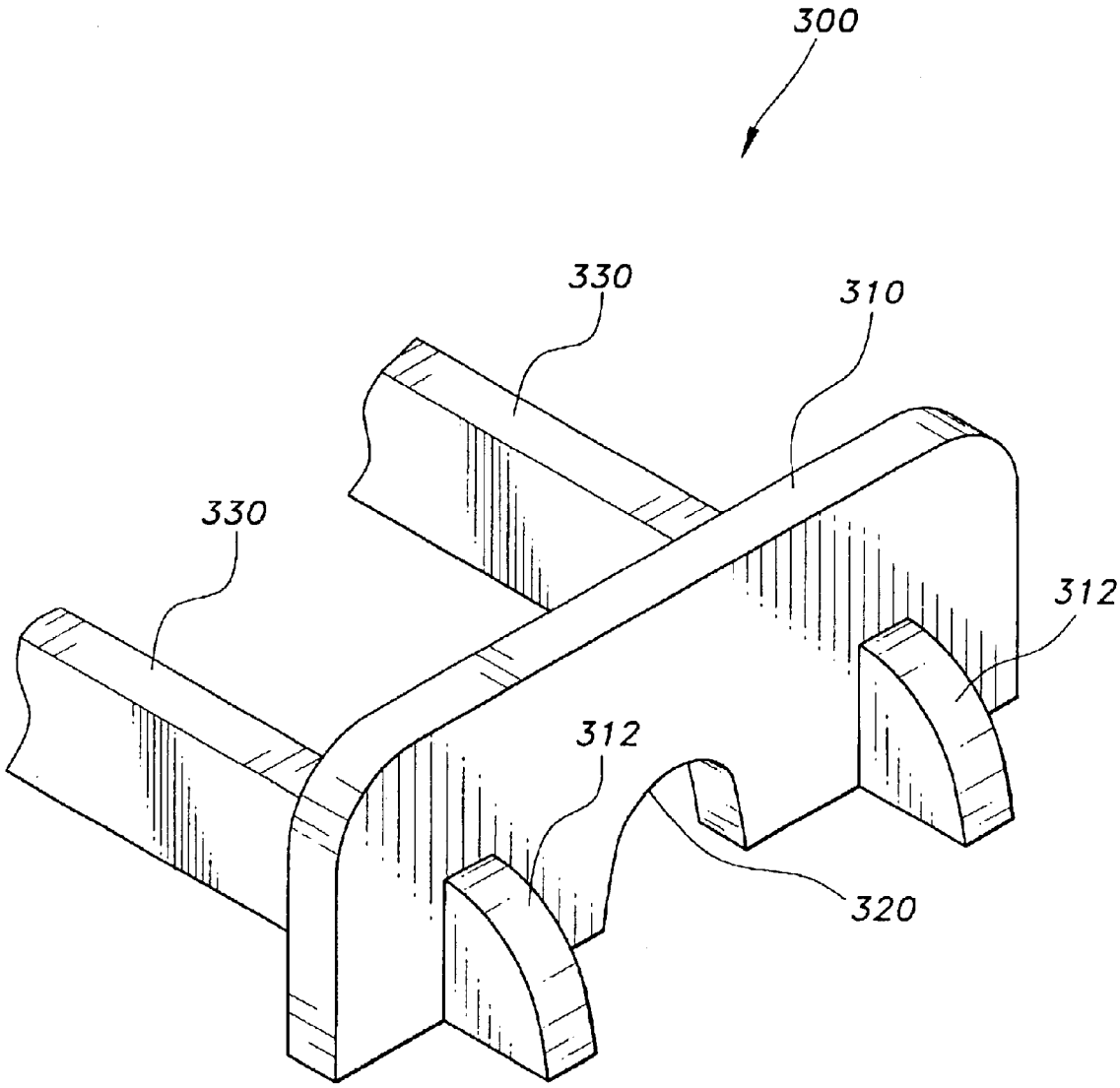
FIG. 7 is a perspective view of a third embodiment of the putting pool game.

FIG. 7 depicts a third embodiment of the putting pool game 300. The present embodiment of the putting pool game 300 is used as a practice game for situations where there is not enough room to set up the entire game frame 20. The practice game provides a practice board 310 with a single ball receiving hole 320 that may be set up to practice putting. The practice board 310 includes two support slots 312 for receiving support members 330. The practice board can be placed anywhere there is limited space to practice the putting pool game.

It is to be understood that the present invention is not limited to the embodiments described above, but encompasses any and all embodiments within the scope of the following claims.

I claim:

1. A putting pool game, comprising:

a plurality of side boards;

a plurality of hinges disposed between adjacent side boards;

wherein the adjacent side boards are pivotally secured to one another by said hinges at adjacent ends to form side walls, and create a center seam on said side wall;

a plurality of fastening plates;

a plurality of end boards releasably attached at each end to said side walls by said plurality of fastening plates to form a rectangular game frame;

wherein said end boards are releasably attached to said side walls by said fastening plates;

a top rail disposed along a top surface of said game frame;

a bottom rail disposed along a bottom portion of said game frame;

said rectangular game frame defining a plurality of ball receiving holes disposed along said bottom portion of said game frame, and passing through said bottom rail:

wherein each of the corners of said rectangular game frame has one of the ball receiving holes defined therethrough, said side walls of said rectangular game frame having at least one of the plurality of ball receiving holes defined therethrough;

a plurality of ball strikers, said ball strikers having the form of golf putting clubs;

a plurality of projection balls, said plurality of projection balls includes at least two sets of balls, each set of said at least two sets of balls having a coloring differing from the coloring the other of each said at least two sets; and at least one striker ball;

whereby said ball strikers are used to apply a force to said striker ball to force said striker ball into contact with said projection balls in an attempt to project said projection balls through the ball receiving holes.

2. The putting pool game according to claim 1, further comprising a container for storing said plurality of projection balls and said striker ball.

3. The putting pool game according to claim 1, further comprising an illumination source.

4. The putting pool game according to claim 3, wherein said illumination source is a black light.

5. The putting pool game according to claim 3, wherein said game frame, said plurality of projection balls and said striker ball are painted to react to said illumination source.

6. The putting pool game according to claim 1, wherein said game frame may be placed on any surface.

7. The putting pool game according to claim 1, further comprising a center board positioned between said sidewalls and parallel to said end boards, wherein said center board further comprises a plurality of center ball receiving holes.

8. A method for playing a putting pool game played by a plurality of players, the putting pool game including a game frame, a plurality of ball receiving holes disposed along said game frame, a storage bucket, a plurality of projection balls, at least one striker ball and a plurality of ball striking clubs, said plurality of projection balls further comprising at least two sets of balls where each set of balls is a different color, said method comprising the steps of:

assigning each of said players a particular set of balls;

starting the putting pool game by one player dumping the plurality of projection balls out of the storage bucket into an open area defined inside of the game frame;

placing the striker ball at one end of the game box for a first shot by a second player; and applying a force to the striker ball with the ball striking club by each player taking alternating turns;

forcing the striker ball into contact with the particular set of balls assigned to the player in an attempt to project the projection balls through the ball receiving holes.

9. The method for playing the putting pool game played by a plurality of players according to claim 8, further comprising the step of repeating the steps of applying a force and forcing the striker ball into contact when one of the projection balls is successfully projected through one of the receiving holes;

wherein each player continues to take shots as long as that player continues to project the projection balls through the ball receiving holes in sequence.

10. The method for playing the putting pool game played by a plurality of players according to claim 8, whereby the playing of the game is continued until one of the players successfully projects the entire set of balls assigned to the player out of the game frame through the ball receiving holes.

11. The putting pool game according to claim 1, further comprising:

a practice board having a top portion with a top rail, and a bottom portion with a bottom rail;

said practice board defining at least one ball receiving hole disposed along said bottom portion, and passing through said bottom rail;

said practice board further defining a pair of slots through the bottom portion thereof; and a pair of supports for engaging the slots of said practice board for supporting the practice board on a playing surface;

wherein said practice board is adapted for limited space usage for practicing projecting said projection balls through the at least one ball receiving hole.

* * * * *